United States Patent [19]

Asari

[11] Patent Number: 4,892,132

[45] Date of Patent: Jan. 9, 1990

[54] CASTING METHOD AND APPARATUS USING TWIN BELT CASTER

[75] Inventor: Takashi Asari, Niihama, Japan

[73] Assignee: Sumitomo Heavy Industries, Ltd., Tokyo, Japan

[21] Appl. No.: 263,312

[22] Filed: Oct. 27, 1988

[30] Foreign Application Priority Data

Oct. 29, 1987 [JP] Japan ..... 62-271675

[51] Int. Cl.[4] ..... B22D 11/06

[52] U.S. Cl. ..... 164/431; 164/432; 164/481; 164/443

[58] Field of Search ..... 164/430, 431, 432, 443, 164/455, 481, 485

[56] References Cited

U.S. PATENT DOCUMENTS

| | | | |
|---|---|---|---|
| 4,298,053 | 11/1981 | Dompas et al. | 164/429 |
| 4,487,157 | 12/1984 | Bergeron et al. | 118/59 |
| 4,487,790 | 12/1984 | Bergeron et al. | 427/422 |
| 4,545,423 | 10/1985 | Platek | 164/485 |
| 4,588,021 | 5/1986 | Bergeron et al. | 164/432 |
| 4,749,027 | 6/1988 | Allyn et al. | 164/485 |

FOREIGN PATENT DOCUMENTS

| | | | |
|---|---|---|---|
| A2416141 | 10/1975 | Fed. Rep. of Germany . | |
| A-2264610 | 3/1975 | France . | |
| 129260 | 6/1986 | Japan | 164/481 |

OTHER PUBLICATIONS

Patent Abstract of Japan, of JP-A-61 212 454, vol. 11, No. 50 (M-562), Feb. 17, 1987.

Patent Abstract of Japan, of JP-A-59 174 254, vol. 9, No. 29 (M-356), Feb. 7, 1985.

*Primary Examiner*—Nicholas P. Godici

*Assistant Examiner*—Edward Brown

*Attorney, Agent, or Firm*—Armstrong, Nikaido, Marmelstein, Kubovcik & Murray

[57] ABSTRACT

A casting method and apparatus making use of a twin belt caster which has an upper belt, a lower belt and dam members disposed between both opposing longitudinal edges of the upper and lower belts. The upper belt, lower belt and dam members in cooperation provide a continuous casting mold which is inclined at a predetermined angle from the horizontal plane and into which a melt of steel is poured. The lower belt provides a smaller cooling effect than the upper belt so that the solidification of the melt is retarded in the region near the lower belt as compared with the region near the upper belt.

4 Claims, 5 Drawing Sheets

CASTING METHOD AND APPARATUS USING TWIN BELT CASTER

BACKGROUND OF THE INVENTION

1. Field of the Invention

The present invention relates to a casting method for casting steel or the like material by means of a twin belt caster and also to a twin belt caster suitable for use in carrying out such a method.

2. Prior Art of the Invention

FIG. 1 shows a known twin belt caster. The twin belt caster has parallel trains of dam blocks 7 arranged to be disposed between opposing longitudinal edges of upper and lower belts 4 and 1. The caster is inclined downward so as to provide a casting angle $\alpha$ of 5° to 15° such that a free surface (referred to as "meniscus" hereafter) of melt 8 for allowing the melt 8 to be poured further is formed in the caster, as will be seen from FIG. 2.

As a result of the downward inclination, the upper belt 4 and the lower belt 1 are offset from each other in the direction of flow of the melt 8 by an amount which is represented by L in FIG. 1. In consequence, the melt 8 which is to be solidified to form a billet 9 starts to solidify at different timings at its portions adjacent to the upper belt 4 and the lower belt 1. Namely, the portions of the melt 8 contacting the upper and lower belts 4 and 1 start to solidify so as to form initial solidification shell which is rigid enough to withstand stress generated by shrinkage or contraction of the melt due to further solidification of the melt under this shell. The initial solidification zone adjacent to the upper belt 4 is shown to have a length $l_t$, while the initial solidification zone adjacent to the lower belt 1 is shown to have a length $l_b$. In consequence, an offset of a length $l_0$ is formed between the terminal ends of the upper initial solidification zone and the lower initial solidification zone. FIGS. 3A to 3C show the melt 8 and the billet 9 in cross-sections taken along different planes which are represented by IIIA, IIIB and IIIC in FIG. 2. More specifically, in the cross-section taken along the plane IIIA, the melt 8 has been solidified only at the bottom contacting the lower belt 1 and both side walls contacting the walls of the dam blocks 7 so that a substantially U-shaped initial solidification shell has been formed, as shown in FIG. 3A. In the cross-section taken along the plane IIIB, the solidification has proceeded so that the lower portion 10 (see FIG. 2) of the U-shaped initial solidification shell has commenced to shrink in the breadthwise direction so as to provide a substantially inverse-trapezoidal cross-sectional shape of the initial solidification shell as shown in FIG. 3B. In the cross-section taken along the plane IIIC, the upper portion of the melt 8 has contacted the upper belt 4 so that an upper shell wall has been formed. In this state, the lower solidification shell has completed its solidification shrinkage and, therefore, has become rigid.

As the solidification further proceeds, the upper shell wall 11 also tends to contract. This tendency, however, is resisted by the rigidity of the lower shell wall 10 which has completed initial solidification. In consequence, a breadthwise internal stress is generated in the upper shell wall 11 so that the cracks c are formed in the upper surface o the billet 9 so as to extend in the longitudinal direction of the billet 9 as shown in FIG. 4, whereby the quality of the product billet is impaired undesirably. In addition, the product billet 9 exhibits an inverse trapezoidal cross-section due to difference in the amount of contraction between the upper solidification shell wall 11 and the lower solidification shell wall 10, thus degrading the quality of the product.

SUMMARY OF THE INVENTION

Accordingly, an object of the present invention is to overcome the above-described problems of the prior art.

To this end, the invention provides casting method and apparatus which make use of a twin belt caster, wherein the cooling effect provided by the lower belt is intentionally reduced as compared with that produced by the upper belt, so that the growth of the lower initial solidification shell wall is delayed in such a manner that the initial solidification take place and proceed substantially simultaneously at the portions of the melt near the upper and lower belts, whereby generation of internal tensile stress attributable to the difference in the amount of contraction between the upper and lower initial solidification shell walls is reduced thereby preventing undesirable effects such as longitudinal cracking and deformation of cross-section of the product billet.

According to one aspect of the present invention, there is provided a casting method making use of a twin belt caster having an upper belt, a lower belt and dam members disposed between both opposing longitudinal edges of the upper and lower belts, the upper belt, lower belt and dam members in cooperation providing a continuous casting mold which is inclined at a predetermined angle from the horizontal plane and into which a melt of steel is poured, the method characterized in that the lower belt has a smaller heat conductivity than the upper belt so that solidification of the melt in the region adjacent to the lower belt is retarded as compared with the region adjacent to the upper belt.

According to another aspect of the invention, there is provided a twin belt caster comprising: an upper belt which can run in one direction; a lower belt which can run together with the upper belt; and dam members disposed between both opposing longitudinal edges of the upper and lower belts, the upper belt, lower belt and dam members in cooperation providing a continuous casting mold which is inclined at a predetermined angle from the horizontal plane and into which a melt of steel is poured; wherein the lower belt has a smaller heat conductivity than the upper belt.

DESCRIPTION OF THE PREFERRED EMBODIMENTS

Figure 1:
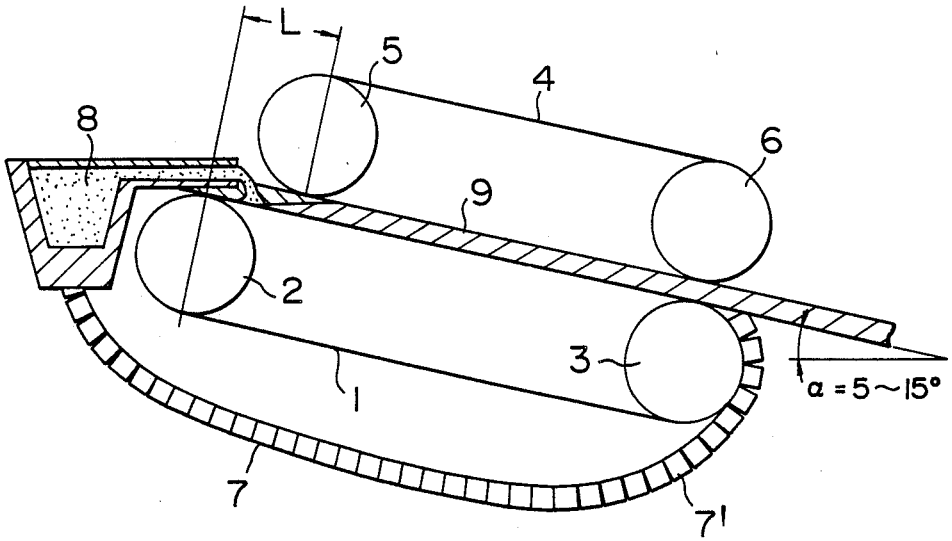
FIG. 1 PRIOR ART
FIG. 1 is a schematic illustration of a known twin belt caster.
Figure 2:
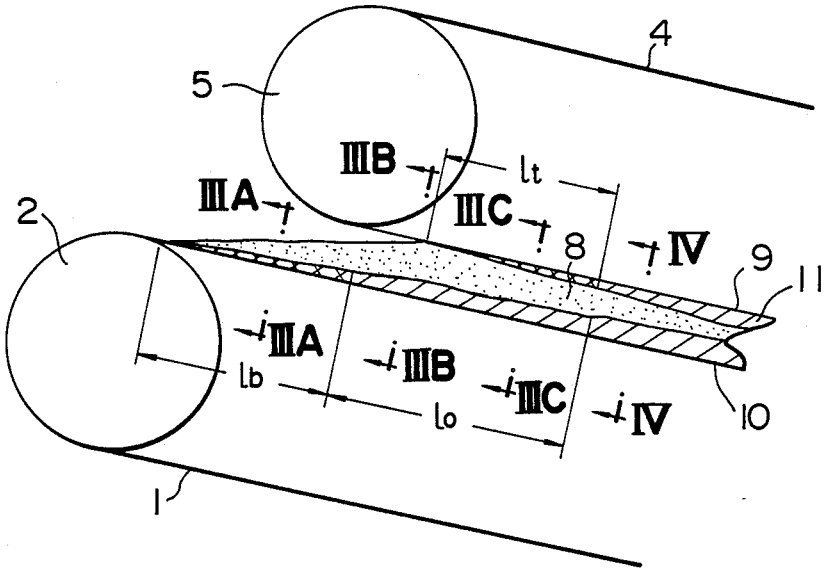
FIG. 2 PRIOR ART
FIG. 2 is a schematic illustration of an essential portion of the twin caster shown in FIG. 1.
Figure 3A:
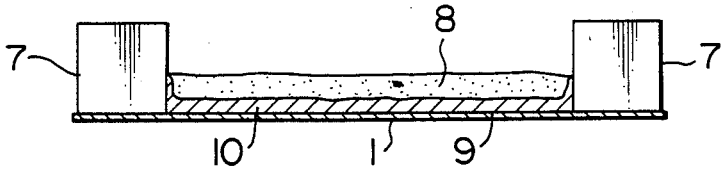
FIG. 3A PRIOR ART
FIGS. 3A, 3B and 3C are sectional views taken along the lines IIIA, IIIB and IIIC of FIG. 2.
Figure 3B:
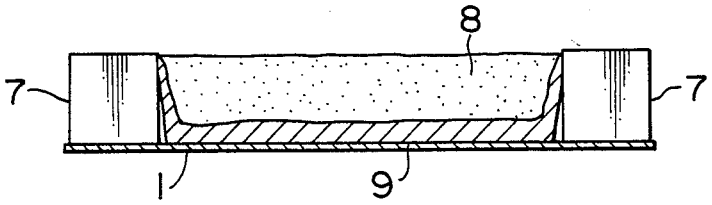
FIG. 3B PRIOR ART
Figure 3C:
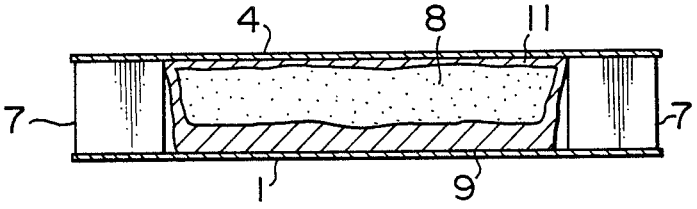
FIG. 3C PRIOR ART
Figure 4:
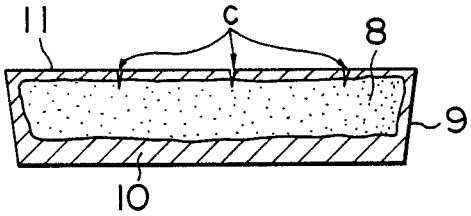
FIG. 4 PRIOR ART
FIG. 4 is a sectional view taken along the line IV—IV of FIG. 2.
Figure 5:
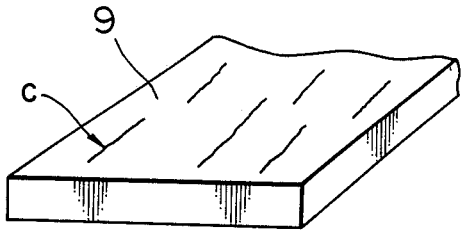
FIG. 5 is a perspective view showing a billet manufacturing by a conventional twin belt caster.
Figure 6:
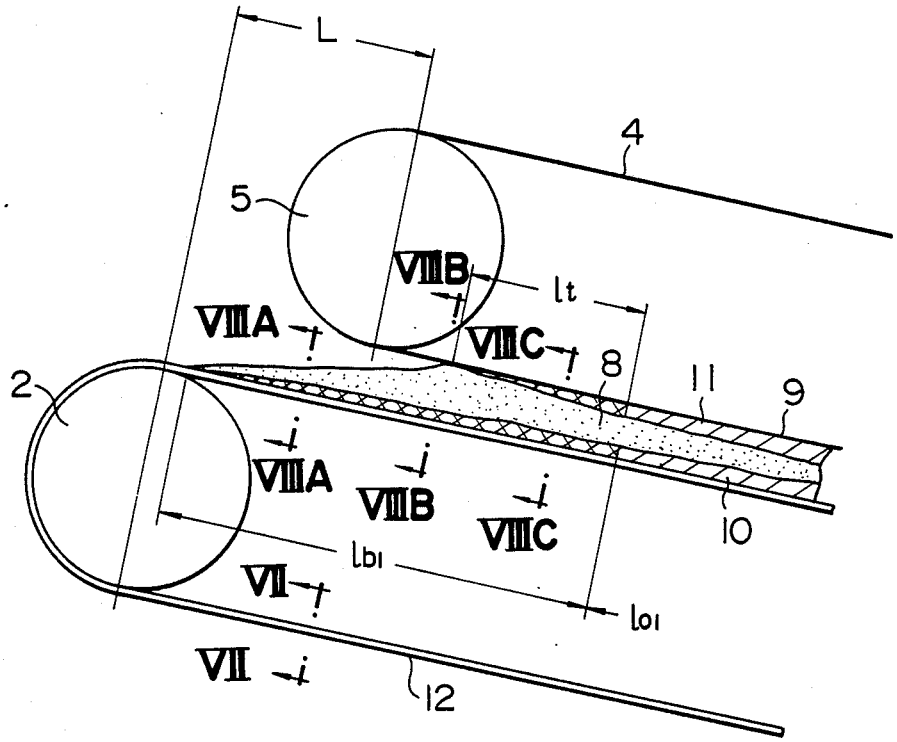
FIG. 6 is a schematic illustration of an essential portion of a casting apparatus embodying the present invention.
Figure 7:
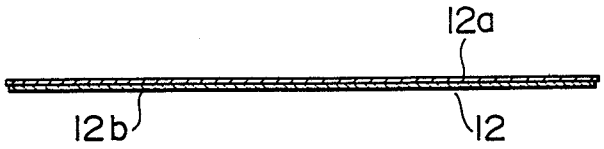
FIG. 7 is a sectional view taken along the line VII—VII of FIG. 6.

A preferred embodiment of the present invention will be described with reference to FIGS. 6 to 10.

Referring to these Figures, a reference numeral 12 denotes a lower belt which is inclined downward at a predetermined casting angle which is about 5° to 15° from the horizontal plane. The lower belt 12 is stretched between the lower inlet pulley 2 and the lower output pulley 3. The lower belt 12 is driven by a driving device (not shown) such as to run around these pulleys 2 and 3. The apparatus also has an upper belt 4 which is stretched between an upper inlet pulley 5 and an upper outlet pulley 6 so as to extend in the direction parallel to the lower belt 12. The upper belt 4 is offset from the lower belt 12 by an amount L in the casting direction, i.e., in the downstream direction as viewed in the direction of flow of the melt.

A reference numeral 7 denotes a dam block train composed of a multiplicity of dam blocks 7' which are connected in series and in an endless manner so as to slide on an endless belt. Each dam block 7' includes left and right walls and has a rectangular form when viewed in side elevation.

The upper run of the dam block train 7 is clamped between opposing longitudinal edge portions of the upper and lower belts 4 and 12 so as to move together with these belts. The dam block train 7 is guided and supported by curved guides and support rolls which are not shown.

Thus, the upper and lower belts 4, 12 and left and right walls of the dam blocks 7' of the dam block train constitute a mold of the endless type 7.

According to the present invention, the lower belt 12 is made of a material which has a smaller heat conductivity than the steel which is used as the material of the lower belt 1 of the conventional continuous casting machine of the type shown in FIG. 1 generally made from a steel such as a low-carbon steel. In consequence, the rate of initial solidification in the region near the lower belt 12 is reduced so as to delay the solidification of the lower initial solidification wall. In consequence, the length $l_{b1}$ of the lower initial solidification zone is increased to reduce the distance or length $l_{01}$ between the terminal ends of the upper initial solidification zone adjacent to the upper belt 4 and the lower initial solidification zone adjacent to the lower belt 12.

More specifically, in the described embodiment, the lower belt 4 has a substrate belt 12*a* of the same material as that used in conventional device and a coating layer 12*b* of 50 to 150μ thick formed under the substrate belt 12*a* from a material which has a small heat conductivity, e.g., a ceramics material.

In this embodiment, the lower belt 12 is composed of the substrate belt 12*a* and the coating layer 12*b* of a material having a small heat conductivity. This, however, is only illustrative and the lower belt 12 can have various other constructions provided that the lower belt is suitable for casting of a steel and that the lower belt exhibits smaller heat conductivity than steel, for instance, the lower belt may wholly be made from a material having a heat conductivity smaller than that of steel, such as, for example, an amber-Ni alloy. Although the described embodiment employs a dam block train 7 which is movable together with the upper and lower belts 4 and 12, this is only illustrative and the arrangement may be such that a stationary dam walls are set for cooperation with the running upper and lower belts so as to define a continuous mold.

Figure 8A:
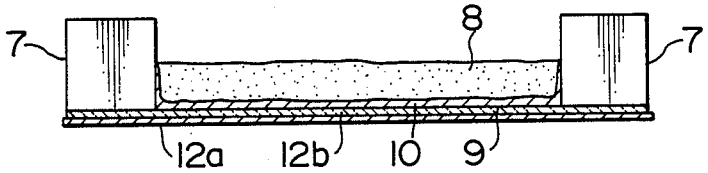
FIGS. 8A, 8B and 8C illustrate cross-sections taken along lines VIIIA, VIIIB and VIIIC in FIG. 6.
Figure 8B:
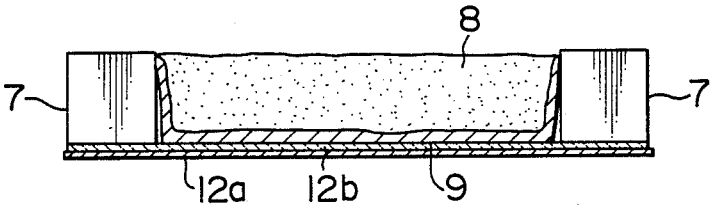
Figure 8C:
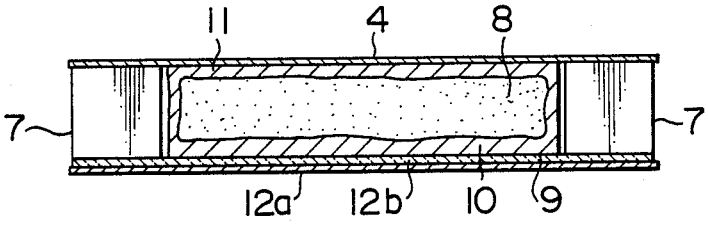
Figure 9:
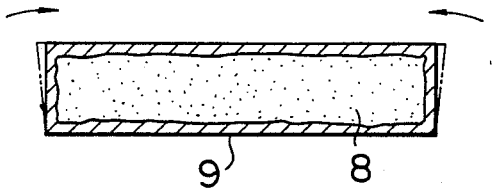
FIG. 9 is an illustration of a cross-section of a billet in the transient period between the states of the cross-sections as shown in FIGS. 8B and 8C.
Figure 10:
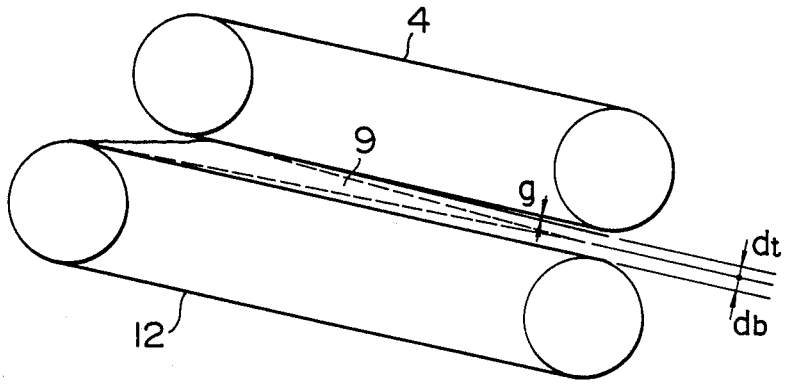
FIG. 10 is an illustration of procedure of solidification of a billet which is being formed in accordance with the method of the present invention.

The operation of the described embodiment is as follows. The upper and lower belts 4 and 12 are driven by the respective driving devices. At the same time, the dam block chain 7 is made to run in synchronization with the upper and lower belts 4 and 12 so that a continuous casting mold is formed by the upper and lower belts 4, 14 and both walls of successive dam blocks 7' of the dam block train 7. A melt 8 of steel which is poured into the continuous casting mold progressively solidifies so as to become a band-like billet 9. The solidification takes place and proceeds in the following manner. FIGS. 8A, 8B and 8C show cross-sections of the melt 8 and the billet 9 taken along planes VIIIA, VIIIB and VIIIC of FIG. 6. Thus, in the portions of the melt denoted by VIIIA and VIIIB in FIG. 6, the portion of the melt 8 adjacent to the lower belt 12 has commenced to solidify so as to form a lower initial solidification shell wall 10. In the described embodiment, however, the rate of growth of the lower initial solidification shell wall 10 is much smaller than that in known casting apparatus of this kind, because the lower belt 12 provides a small cooling effect due to the presence of the layer 12*b* made of a material having a small heat conductivity. Thereafter the melt 8 is brought into contact with the upper belt 4 so as to start formation of the upper initial solidification wall 11. In this state, the lower initial solidification shell wall 10 has not yet been solidified to such an extent as to produce any force which would restrict the contraction of the upper initial solidification shell wall 11. In the cross-section taken along the plane VIIIC, the cross-section is progressively changed from a slightly inverse trapezoidal form in the plane VIIIB into a regular rectangular form as the solidification further proceeds, because the force for restricting the contraction of the upper initial solidification shell wall 11 is decreased due to the delay in the growth of the lower initial solidification shell wall 10.

Since the solidification speed is lower in the region adjacent to the lower belt 12 than in the region adjacent to the upper belt 4, it is conceiveable that, in the downstream end of the caster, the upper shell wall has a thickness dt which is greater than the thickness db of the lower shell wall. Actually, however, an air gap g is formed between the upper belt 4 and the billet 9 partly because of the thicknesswise contraction of the billet 9 and partly because of the weight of the billet 9, so that the cooling effect provided by the upper belt 4 is reduced by the air gap g which serves as a heat-insulating layer.

This tendency conveniently serves to reduce the difference between the thicknesses dt and db of the upper and lower shell walls in the downstream region of the caster.

As has been described. According to the present invention, the growth of the lower initial solidification shell wall is retarded as compared with the upper initial solidification shell wall such that both initial solidification shell walls solidify substantially simultaneously. In consequence, solidification shrinkage or contraction takes place substantially at the same rate both in the region adjacent to the upper belt and the region adjacent to the lower wall, so that generation of defects such as longitudinal cracks c in the billet surface is suppressed and shape and dimensional precision of the billet are remarkably improved.

What is claimed is:

1. A casting method making use of a twin belt caster having an upper belt, a lower belt and dam members disposed between both opposing longitudinal edges of said upper and lower belts, said upper belt, lower belt and dam members in cooperation providing a continuous casting mold which is inclined at a predetermined angle from the horizontal plane and into which a melt of steel is poured, said method characterized in that said lower belt has a smaller heat conductivity than said upper belt so that solidification of said melt in the region adjacent to said lower belt is retarded as compared with the region adjacent to said upper belt.

2. A twin belt caster comprising:

an upper belt which can run in one direction;

a lower belt which can run together with said upper belt;

and dam members disposed between both opposing longitudinal edges of said upper and lower belts, said upper belt, lower belt and dam members in cooperation providing a continuous casting mold which is inclined at a predetermined angle from the horizontal plane and into which a melt of steel is poured;

wherein said lower belt has a smaller heat conductivity than said upper belt.

3. A twin belt caster according to claim 2, wherein said lower belt has a substrate belt made of steel and a coating layer formed on the surface of said substrate belt from material having a small heat conductivity such as ceramics material.

4. A twin belt caster according to claim 2, wherein said lower belt is wholly made from material having a small heat conductivity such as Ni-alloy.

* * * * *